United States Patent [19]

Becker et al.

[11] Patent Number: 4,683,032

[45] Date of Patent: Jul. 28, 1987

[54] COKE OVEN DOORS FOR HORIZONTAL CHAMBER COKE OVENS

[75] Inventors: Wolfgang Becker, Herne; Heinz Tewes, Gelsenkirchen-Buer, both of Fed. Rep. of Germany

[73] Assignee: Ruhrkohle Aktiengesellschaft, Essen, Fed. Rep. of Germany

[21] Appl. No.: 708,097

[22] Filed: Mar. 4, 1985

Related U.S. Application Data

[63] Continuation of Ser. No. 524,921, Aug. 19, 1983, abandoned.

[30] Foreign Application Priority Data

Jan. 21, 1983 [DE] Fed. Rep. of Germany ..... 3301877
Apr. 2, 1983 [DE] Fed. Rep. of Germany ..... 3312072

[51] Int. Cl.[4] ..... C10B 25/06; C10B 25/16
[52] U.S. Cl. ..... 202/248; 202/269
[58] Field of Search ..... 202/247, 248, 269; 110/173 R

[56] References Cited

U.S. PATENT DOCUMENTS

| | | | |
|---|---|---|---|
| 2,878,170 | 3/1959 | Forsans | 202/247 |
| 2,993,845 | 7/1961 | Coe | 202/248 |
| 3,952,454 | 4/1976 | Sudo | 202/248 |
| 4,036,702 | 7/1977 | Nagayoshi | 202/248 |
| 4,086,145 | 4/1978 | Muller | 202/248 |
| 4,086,231 | 4/1978 | Ikio | 202/269 |
| 4,198,274 | 4/1980 | Ikio | 202/248 |
| 4,217,177 | 8/1980 | Gerding et al. | 202/248 |
| 4,226,679 | 10/1980 | Kelly et al. | 202/248 |
| 4,293,389 | 10/1981 | Clement | 202/248 |
| 4,337,122 | 6/1982 | Kurihara | 202/248 |
| 4,390,397 | 6/1983 | Sczerba | 202/243 |
| 4,414,072 | 11/1983 | Breidenbach et al. | 202/248 |

FOREIGN PATENT DOCUMENTS

| | | | |
|---|---|---|---|
| 86457 | 5/1977 | Australia | 202/248 |
| 930325 | 7/1973 | Canada | 202/248 |
| 0031130 | 7/1981 | European Pat. Off. | 202/248 |
| 186934 | 11/1905 | Fed. Rep. of Germany . | |
| 238363 | 3/1910 | Fed. Rep. of Germany . | |
| 732547 | 3/1943 | Fed. Rep. of Germany . | |
| 913764 | 6/1954 | Fed. Rep. of Germany . | |
| 3105726 | 3/1982 | Fed. Rep. of Germany . | |
| 3105703 | 6/1982 | Fed. Rep. of Germany . | |
| 3123248 | 1/1983 | Fed. Rep. of Germany | 202/248 |
| 1087455 | 2/1955 | France | 202/248 |

*Primary Examiner*—Peter Kratz
*Attorney, Agent, or Firm*—Nils H. Ljungman

[57] ABSTRACT

This invention is directed to an extremely lightweight construction for coke oven doors made to provide optimal sealing; the oven door comprises one sealing unit having a seal, and closing forces are applied to act uniformally on the seal, thereby minimizing heat loss between the sealing unit and the coke oven as much as possible. The oven door, on its outside surface, is also provided with a boxed duct structure which in use is vertical and has an open top; the boxed structure facilitates heat dissipation by the door outside surface, by convection air flow in the boxed structure.

16 Claims, 22 Drawing Figures

COKE OVEN DOORS FOR HORIZONTAL CHAMBER COKE OVENS

This is a continuation of the U.S. application Ser. No. 06/524,921, filed on Aug. 19, 1983 now abandoned.

FIELD OF THE INVENTION

This invention relates to a coke oven door for a horizontal-chamber coking oven and more particularly to a door stopper for such a door.

BACKGROUND OF THE INVENTION

During the coking process, an uneven heating of the oven door takes place. This will cause the oven door to warp. The extent of such warp increases with increasing oven height and door length. The warping effect has been dealt with by designing doors of extra heavy construction, but the increase of the material used causes increasing deformation because of rising differentials in the temperature gradients. A lifting of the doors can counteract the closing pressure for each oven door and its two locking units. These locking devices act on the top and bottom third of the door against the coke oven door and press against the door with a force of up to 15 Mp against the door frame. As experience in oven operation has shown, even a perfect sealing strip does not prevent leakage, which causes considerable wear at the door frame, as the pressure is conducted in a linear direction over the sealing strip edges, which in turn causes depressions in the door frame. The door stopper is made from high-heat resistant material, which protrudes into the oven chamber and which is connected to the door member and which keeps the oven filling at a distance from the door member. The stopper, together with the coke oven door, fulfills a multiple function. It is supposed to hold back the charge during the coking operation, minimize the heat load on the door member and ensure that the gas exhaust is led to a central gas collector at modern coke ovens. The door member forms a support bearing for the stopper and also closes the opening to the door frame to assure a tight seal. For sealing between door and frame, additional seals are provided, the most common form being a spring mounted bar design, which is supported by the door member and which pushes against the door frame by means of a knife edge when the oven doors are closed. Rough handling of the oven leads nevertheless to damage of the sealing edges. At the damaged spots, coking gas will escape during operation. Such leaks are undesirable because of their impact on the environment and the problems for the operators. For this reason, a number of tests have lately been conducted, to solve the problem of leakage. Conventional solutions have nevertheless remained unsatisfactory.

OBJECT OF THE INVENTION

The invention has the object of eliminating or reducing leakage at coke oven doors.

SUMMARY OF THE INVENTION

According to this invention, the heat affecting the oven door is largely eliminated, otherwise the heat can lead to a distortion of the oven door. This is accomplished by designing the oven doors in several sections and one separate force transmittal unit and separate sealing unit. The force transmittal unit and the sealing unit are connected in as few places as possible, i.e. they feature few heat transmittal points. The connection points, or heat transmittal points, are limited to a preferred design used by this invention, whereby 1 to 2 joints or hold-down points are used which retain the sealing unit in the force unit when the door is opened or closed. Pressure points, upon which the force transmittal unit holds the sealing element against the door frame, provide the sealing action during the coking process. In the design with two joints or hold-down units, these joints provide all the clamping action with the available two locking devices. The two joints may be used when remodeling existing ovens to provide doors covered by the invention. For cost reasons, the existing locking devices may be left to remain intact. For new furnaces with very large door heights, for which more than two locking units are needed, two joints or hold-downs will preferably be retained.

A utilization of two separate joints makes it possible, to place such joints or hold-downs at any place between the sealing unit and the force transmittal unit. Joints can also be limited to one per unit. In such case, it is preferable to locate such joint or hold-down in the upper half vertically in the center. To avoid undesirable movement, especially from the vertical, the seal unit can be positioned rigidly by means of auxiliary holding devices. Such devices can be located at the door lift mechanism of the coke oven service unit. Auxiliary devices can be electrical, mechanical, hydraulic, or pneumatic type.

New furnaces of low height (4 m) enable the designer to get away with only one door lock for the oven door covered by this invention. Thus considerable cost advantages can be achieved.

It is also possible to delete the joints or hold-downs and to lift the sealing unit directly with the door lifting unit and then reposition it accordingly.

To manipulate the seal unit together with the door lifting mechanism, various mechanical methods can be used. Specifically, clamps, hooks, or electric magnets can be used.

For a separate mounting of sealing unit and force transmission unit, a door design can be conceived, wherein one door fulfills the sealing function and the other fulfills the functions of force transmittal. This doubling of the door functions does not lead to a doubling of the material required, but makes a lightweight design possible. The sealing unit, as well as the door member, is not subjected to unusual forces of bending and twisting. On the other hand, the sealing unit should be specifically soft. This has the advantage of easy conformity to the door frame, so as to seal the unit.

The heat load of the sealing unit does not prevent the application of soft seals. The extent of the gas pressures and the pressure of the oven charge do not cause problems of temperature, if the sealing element comprises steel. This is additionally true, since the sealing element on the chamber side can be insulated. Even ordinary structural steel can be used. The seal can be flexible and made of material a few millimeters thick. Such a flexible wall will be adaptable to all door frames. They can be used with minimal forces on the door frame.

The low heat transmittal possibilities on the force transmittal unit, which holds the seal against the door frame, prevent a distortion of the force transmittal unit, so that the design of a force transmittal unit can be limited to the forces required to position the sealing unit against the door frame. In comparison with conventional designs of doors of cast gray iron or cast steel, as well as doors of welded construction, the invention makes a lightweight construction possible, even with commercially available steel sections. By using optimal hollow shapes, such frames derive stiffness. At the same time, these frames can be easily ventilated, by opening the longitudinal members preferably at top and bottom, with openings available at the joints between longitudinal and lateral braces. The longitudinal members act as chimneys. The air stream generated, provides excellent cooling. The lightweight construction, which this invention makes possible, offers considerable weight savings in the design of coke oven doors. In comparison with conventional casting, weights for doors can be lowered by two-thirds, and in extreme cases, by three-fourths.

The advantages of separating force transmittal units from flexible sealing units, are as follows:

1. The undesirable heat cross-over to the force transmittal unit can be avoided.

2. The force transmittal unit remains true to shape, and consequently lends itself to an open hollow construction.

3. The hollow section frame withstands outside incident forces by way of the interlock.

4. The sealing element provides an excellent seal, due to its curved shape and lower surface temperatures.

As a consequence of smaller wall thicknesses (low temperature gradient), as well as minimal thermal stresses, the seal will perform perfectly. As a consequence of its flexibility, it will be able to follow the flexing of the frame, conforming to externally induced forces.

The bulging, together with the door stopper, provides an opportunity of optimal design of the desired gas channel in the door.

5. Because of the form-stability, especially by the force transmittal unit and the flexibility of the sealing element, the required forces can be adjusted by way of the bolts or springs. Improved operational ability is also obtained, 6. The door construction calls for less weight than with conventional door designs, providing for easier construction, maintenance, and repair. The door removal and positioning unit will require less force, resulting in lower wear. This also applies to the seal of the chamber frame.

7. All components of the door can be fabricated using conventional sections, bolts and fasteners, as well as springs.

8. Damage occurring at the force transmittal unit or the sealing unit, can be corrected quickly, by replacement of these units. Whereas conventional doors are subject to repeated repair, especially on membranes, sealing strips, and other components, the door construction according to this invention does not require jacking up, when replacing the sealing units. Any available hoist at the job site will be sufficient.

9. The sealing element can provide an effective sealing surface parallel to the door frame seal. This parallel arrangement of sealing components makes for improved sealing possibilities. Between the sealing surface of the sealing element and the door frame, soft seals can be used, which can be mounted on conventional doors by means of non-metallic strips from the outside, in order to prevent leakage. Soft seals should be fitted with a heat barrier against the oven chamber. Instead of soft seals, modern spring seals and labyrinth seals can also be used.

BRIEF DESCRIPTION OF THE DRAWINGS

The above, as well as other features and advantages of this invention, will become apparent through a consideration of the detailed description and accompanying drawings, in which.

DETAILED DESCRIPTION OF THE INVENTION

Figure 1:
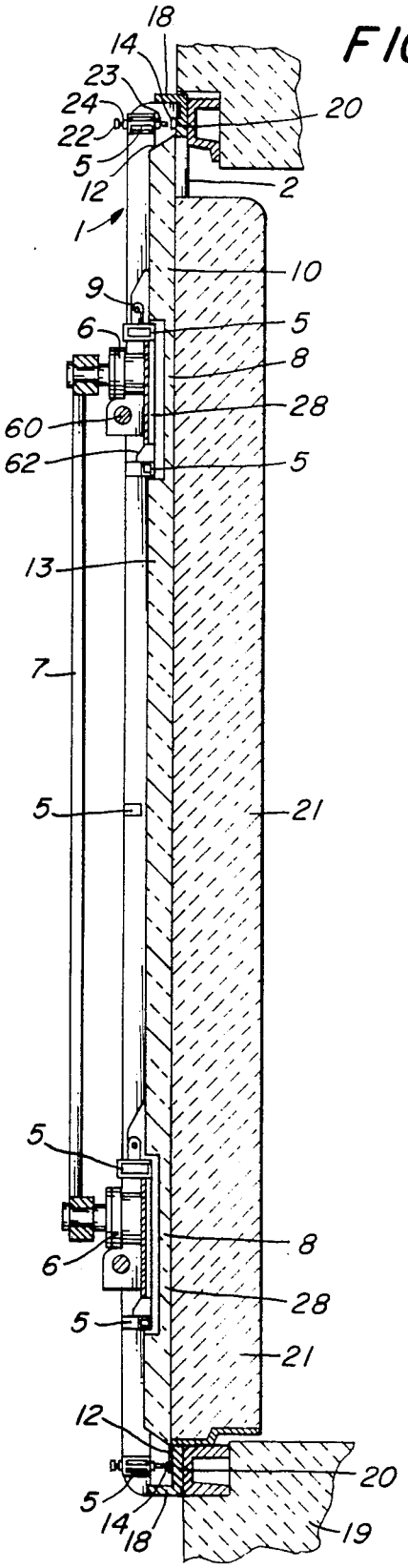
FIG. 1 shows the invention of the coke oven door in cross section during operation and in closed position at the door frame.
Figure 2:
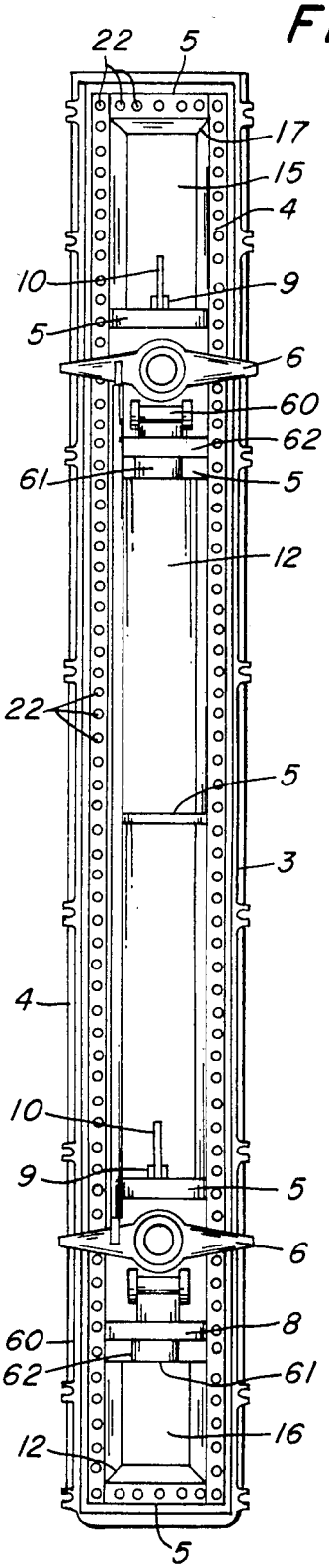
FIG. 2 shows the invented oven door according to FIG. 1 in side view
Figure 1A:
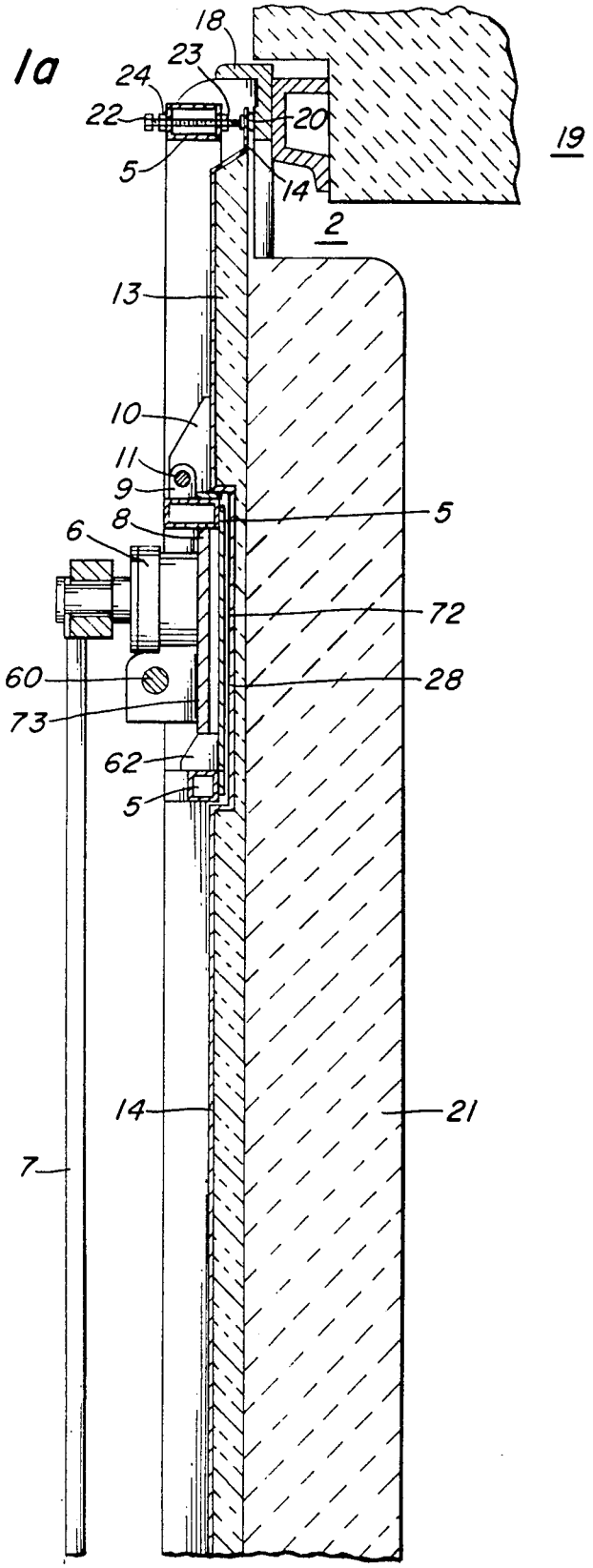
FIG. 1*a* shows a partial section taken from FIG. 1, enlarged.
Figure 3:
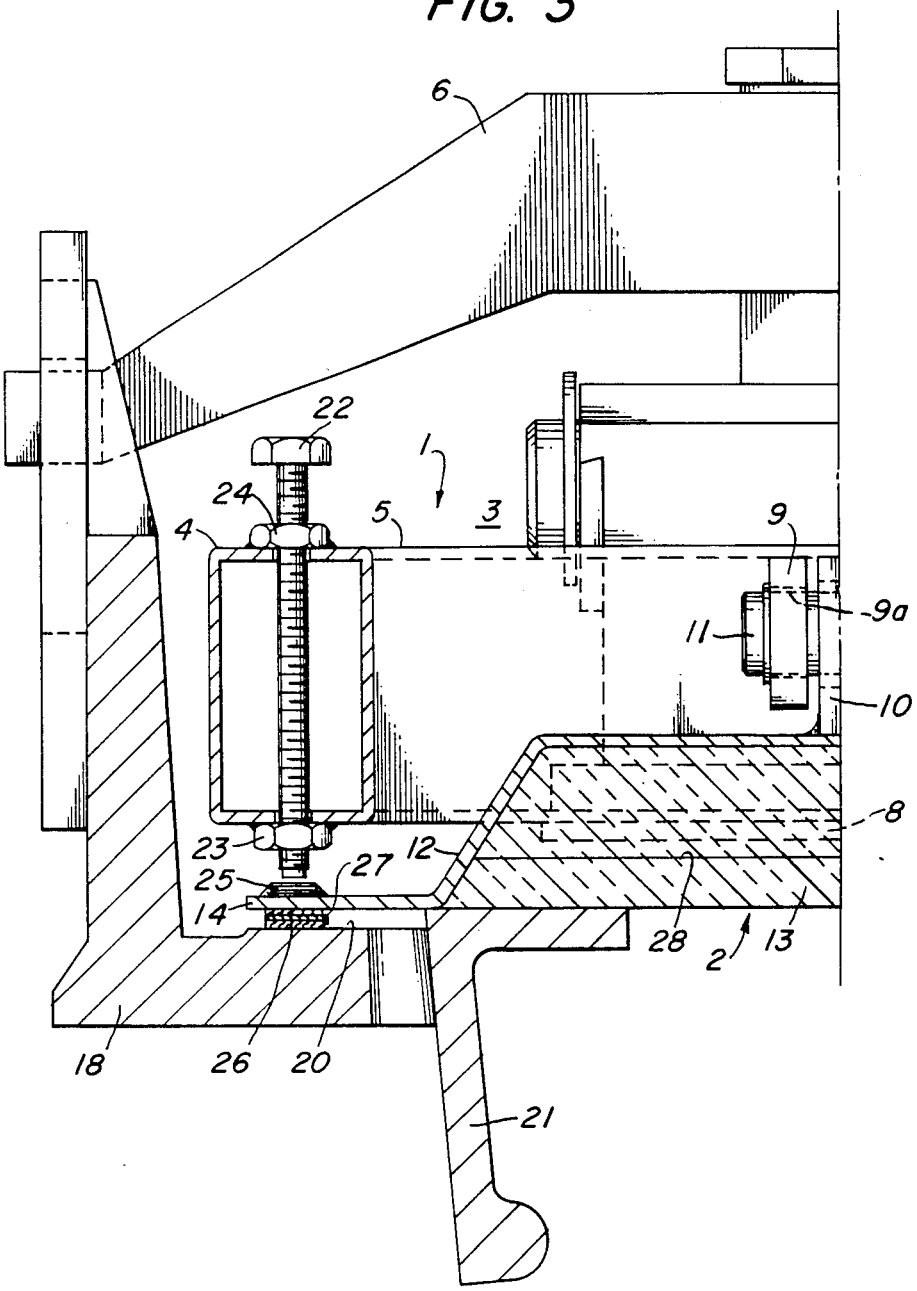
FIG. 3 shows an enlarged view of a horizontal section along the locking device.

According to FIGS. 1 to 3, the coke oven door covered by this invention, comprises a force transmittal unit 1 and a sealing unit 2. The force transmittal unit 1 is designed to include hollow frame 3, with longitudinal members in FIG. 2 designated as 4, and the lateral members in FIG. 2 designated as 5. Longitudinal members 4 are open at the top and bottom end. The longitudinal members have openings at the connecting points with lateral members 5, to permit heated air from hollow frame 3 to exit into longitudinal members 4 and from there to the top in hollow frame 3. The hollow frame 3 comprises conventional square sections of ST 37 steel, 80 mm×40 mm size with a wall thickness of 4 mm. The frame can also be made of other sections, such as hollow rounds, angles, I-beams, T-shapes, or channels. Commercial rolled sections or welded shapes can be used. These shapes can also be used in different positions. This applies specifically to channels.

The door shown in FIGS. 1 to 3 is suitable for remodeling existing 6 m high horizontal coking chambers, which are equipped with doors with two locking devices 6 and which are activated jointly by a locking bar 7. These locking devices are actuated by a mechanical lever arrangement not shown here. The connections with the hollow frame 3 are made by way of locking devices 6 which are bolted to plates 72 with locking plates 8 and welded at top and bottom to lateral members 5 of hollow frame 3. Compensator plates 73 are mounted between locking plates 8 and plates 72, which act as auxiliary devices for adjusting the locking unit on the chamber frame. The locking hooks are not shown. To permit the door lifting unit to catch bolts 60 of locking unit 6, the lateral member 5 below is marked at reference numeral 61 to indicate the location of a depression. Stiffener ribs 62 are added between the locking units 6 and the lateral member 5 below.

Lateral members 5 are welded to locking plate 8 and a clevis 9. This clevis comprises a boss 10 at sealing unit 2. Boss 10 and clevis 9 together form a flexible joint for seal unit 2 at force transmittal unit 1, by means of connecting bolt 11. Because of the existing two joints at locking unit 6, sealing unit 2 is connected to force transmittal unit 1 at two points.

Figure 16:
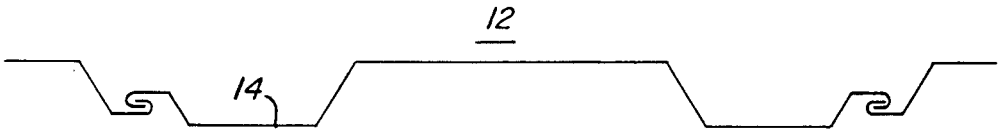
FIGS. 16 to 19 show sealing elements with suitable shapes for doors according to this invention.

According to FIGS. 1 to 3, the sealing unit 2 comprises a sealing element 12 and insulation 13. Sealing element 12 was manufactured from a plate of 6 mm thickness, shown in FIG. 16, and fitted with a free leg as shown in FIGS. 16 and 3 and designated as 14. Depending on shape, a thickness of between 4 and 7 mm is envisaged for the element 12. The height of the oven has no bearing on said thickness, nor has the oven width any influence, as the back pressures of the oven charge per surface unit do not deviate noticeably with conventional ovens. The resulting total pressure is separately accommodated according to oven height and other design considerations.

The plate has been cut at the top and bottom ends 15 and 16 and saw-cut at 17 in such a way, that a bending to the shape shown in FIG. 3 and welding with the other shapes is possible. This provides for a sealing element 12, with centrally located bulge and rounded corner shape, which assures a parallel position of free leg 14 in relation to door frame 18 of coke oven 19. The parallel location of free leg 14 is in line with sealing surface 20 of door frame 18.

The parallel free leg 14 blends into the plate over a sloped path, according to FIGS. 3 and 16. The depression formed is filled with insulation material. Mineral fibers, ceramic fibers, glass fibers, or light fire brick can be used as insulation. The material is either selected in such a way that insulation 13 is mounted on door stopper mount 21, as shown in FIG. 3, or, the insulation 13 is held by suitable anchors for door stopper mount 21. For anchors, screw anchors can be screwed into sealing element 12 or welded into the sealing element and then secured by nuts on the other side of the sealing element. Brackets can also be used, which comprises cut angles which are welded to the sloped surface of sealing element 12 in such a way that one leg runs parallel to the sealing surface 20. In this leg, the mounting can be done in the same way as with direct mounting to sealing element 12. The door stop mounting can have various shapes. It is preferred that metallic or non-metallic light-weight stoppers be used for the oven door. The metallic design comprises door stoppers with plates which overlap from top to the bottom at door stop mount 21, or which are secured by other means through bolting or other fasteners to door stopper mount 21.

Advantageously, the door stopper may protrude into the oven chamber for keeping the oven filling at a distance from the door member.

Utilization of lightweight stoppers entails using commercial sections for the hollow frame 3 and the sealing element for the coke oven door. In the example shown, weight savings of more than two-thirds of the total weight can be realized in comparison with doors of prior art construction.

During the coking process, the door is in closed position as shown in FIG. 1, and the sealing element 12 of hollow frame 3 is pressed at free leg 14 by means of bolts 22 against sealing surface 20 of door frame 18. The side of frame 3 is drilled in such a way that bolt 22 can be screwed from the outside through the members into nuts 23. Bolts 22 are secured by lock nuts 24 in the respective tightening position. In addition to bolt 22 shown in FIG. 3, a large number of other bolts are equally spaced along frame 3. The spacing between such bolts is 100 mm in example shown, but can be reduced if desired. The upper limit of the bolt spacing is 250 mm. Such spacing provides for a possibility of using bolts 22 for a complete even-pressing of the sealing element 12 against sealing surface 20. Each bolt shown can be manually tightened with a wrench, in order to eliminate any uneven sealing pressure of force unit 1 in the closing position of the coke oven door. A torque wrench should preferably be used. A manual adjustment may be sufficient. Instead of nuts 23, a continuous flat bar can be used at the hollow frame, which is equipped with threaded holes for bolts 22.

According to FIG. 3, each bolt 22 is pressed against a shim 25 on sealing element 12. This shim comprises metallic or non-metallic material and can be changed easily. A non-metallic shim has certain advantages from a heat transfer point-of-view. Shim 25 of non-metallic flexible material makes the shim lighter and accommodates heat expansion of the sealing element and any subsequent movement of free leg 14. Serving as a wearing part, this metallic shim 25 assures an extended use of sealing element 12, even after gouging of bolt 22 into the surface. If loose, shim 25 can easily be replaced; alternatively, shim 25 can be welded as a steel component with sealing element 12, or inserted separately into a welded ring holder or other retainer welded to sealing element 12.

Between free leg 14 and sealing surface 20 of the door frame 18, the figure shows a soft seal 26. This soft seal comprises mineral fibers or heat resistant plastic and is fastened to the free leg 14 of sealing element 12 by way of corner guard 27, which is in turn fastened to free leg 14. Corner protection member 27 forms an angle and comprises in the initial position the soft seal 26 only in part at the small side towards the stopper, so that a pressing of the sealing element 12 leads to a positioning of corner guard 27 against the free leg 14 and the strip which upon deformation of soft seal 26 faces the small side towards the stopper. In this position, the corner guard 27 will prevent a deterioration of the soft seal by coke gas condensation during operation. In addition, corner guard 27 will prevent undue pressing and the subsequent damage of the soft seal 26 by pressing against sealing surface 20 of door frame 18, with the subsequent gap position of the free leg 14. Under normal conditions, the corner guard isolates raw gas condensation. Corner guard 27 is welded continuously as steel strip with the free leg 14, or may be riveted or bolted.

The sealing ability of sealing element 12 against sealing surface 20 with depressions 28 at the back of sealing element 12 will advantageously influence the sealing of the coke oven door. The sectional deviation caused by depressions 28 provides for a higher degree of flexibility of sealing element 12. Other examples show additional depressions 28 in a lateral direction to the longitudinal door position. The cross section of the additional depressions can thus be much smaller than depressions 28. The depressions shown may be formed by burning, sawing or milling of the sealing element 12 at the bulged back side. The opening obtained will be closed by sheets which fit the contour of the opening, thus providing a completely closed back of sealing element 12.

The closed position in FIGS. 1 and 3 shows the sealing element pressed against the chamber frame by way of bolts 22 and force unit 1 or hollow frame 3. The joints of lateral members 5 with sealing unit 2 provide sufficient play of 5–15 mm plus allowance for heat expansion of sealing unit 2 by lifting of pivot bolt 11 from the bearing surfaces in clevis 9. This lift-off is very advantageous, because it produces a heat-insulating air gap **9*a* between the bearing surfaces of the clevis and a reduction of the heat load on the hollow frame. The bearing surface of bolt 22** is formed preferably by an elongated hole, elongated in the longitudinal direction of the oven door. The elongated hole is preferred to accommodate the heat expansion of the sealing element in the longitudinal direction of the oven, which expansion is much larger than that in the lateral direction.

For connecting the force transmittal unit and the hollow frame, a detachable coupling may be used instead of the joint shown in FIGS. 1 through 3. Electromechanical and mechanical couplings can be used, which are disengaged in the closed position.

Figure 4:
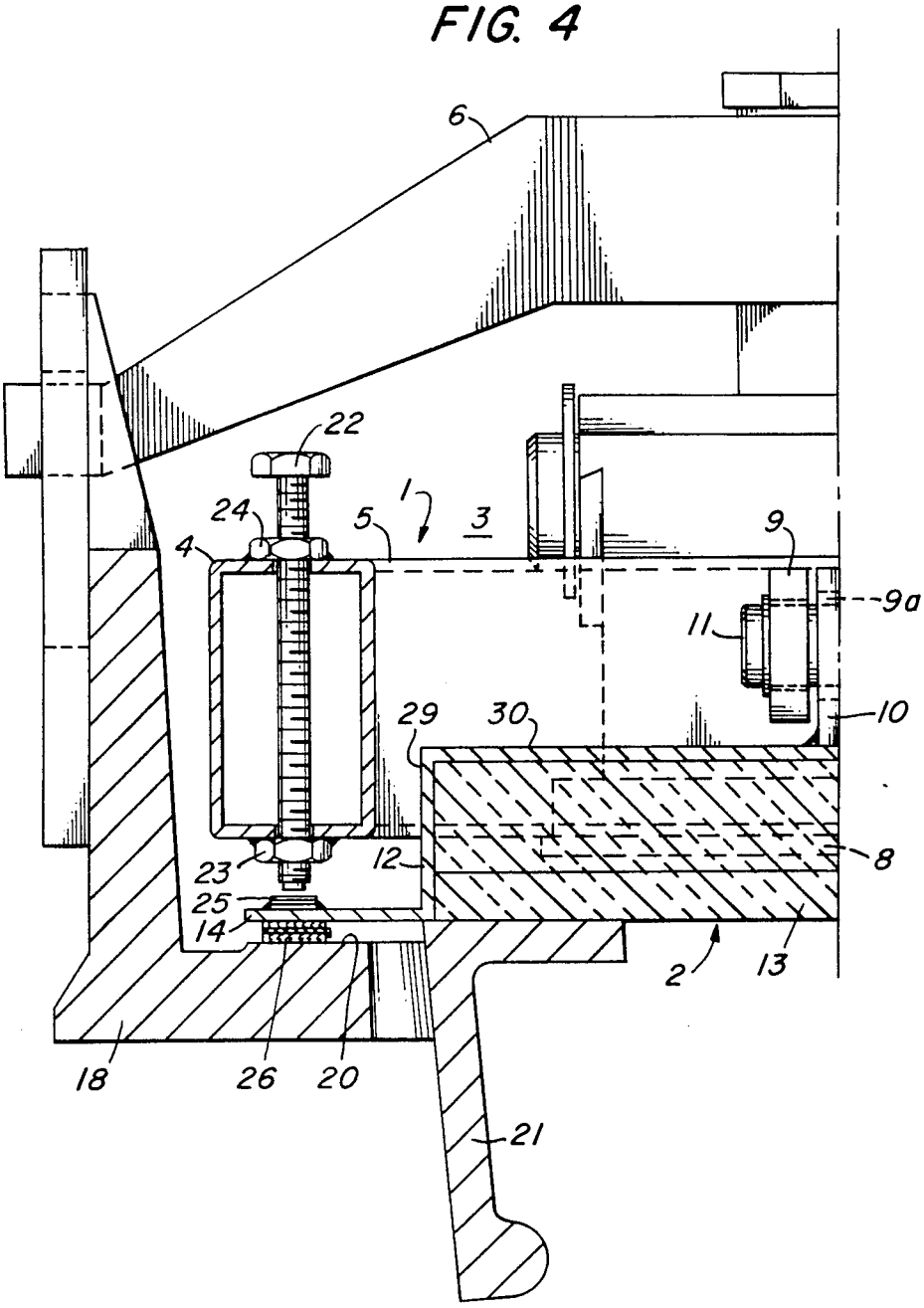
FIGS. 4 to 15 show the same as FIG. 3, with additional coke oven door possibilities under this invention.
Figure 5:
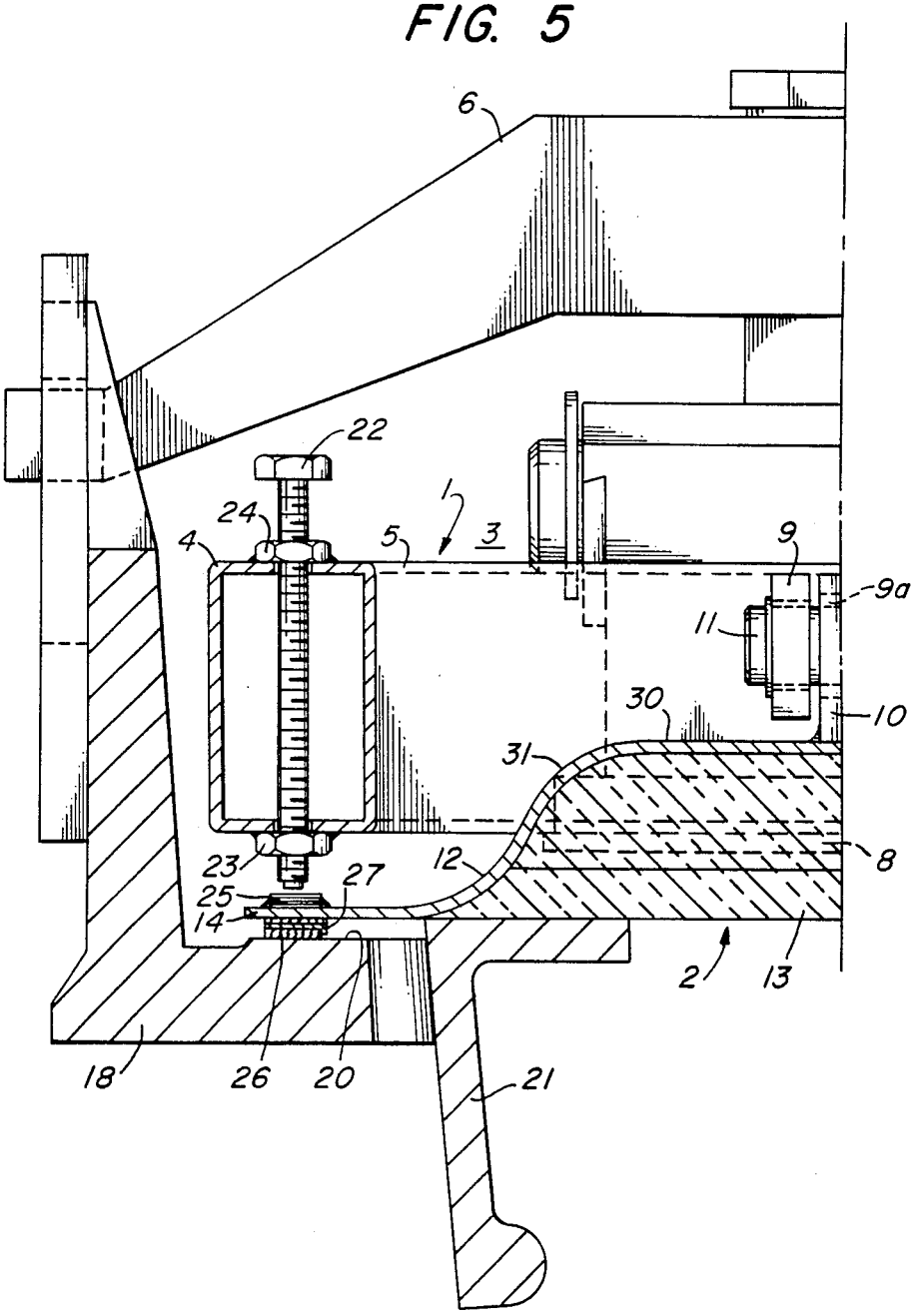

FIG. 4 shows another embodiment of the invented coke oven door, which differs from those shown in FIGS. 1 and 2, in the shape of the sealing element 12. Brace 29 shown in FIG. 4 between the free leg 14 and the back 30 of the sealing element 12 is positioned vertically on sealing surface 20. This has direct impact on the flexibility and the movement of the sealing element during the closing process. According to FIG. 5, the flexibility and movement of the sealing element are influenced by an S-shaped or sine curve shaped line between the free leg 14 and the back 30 of strut 31.

Figure 5A:
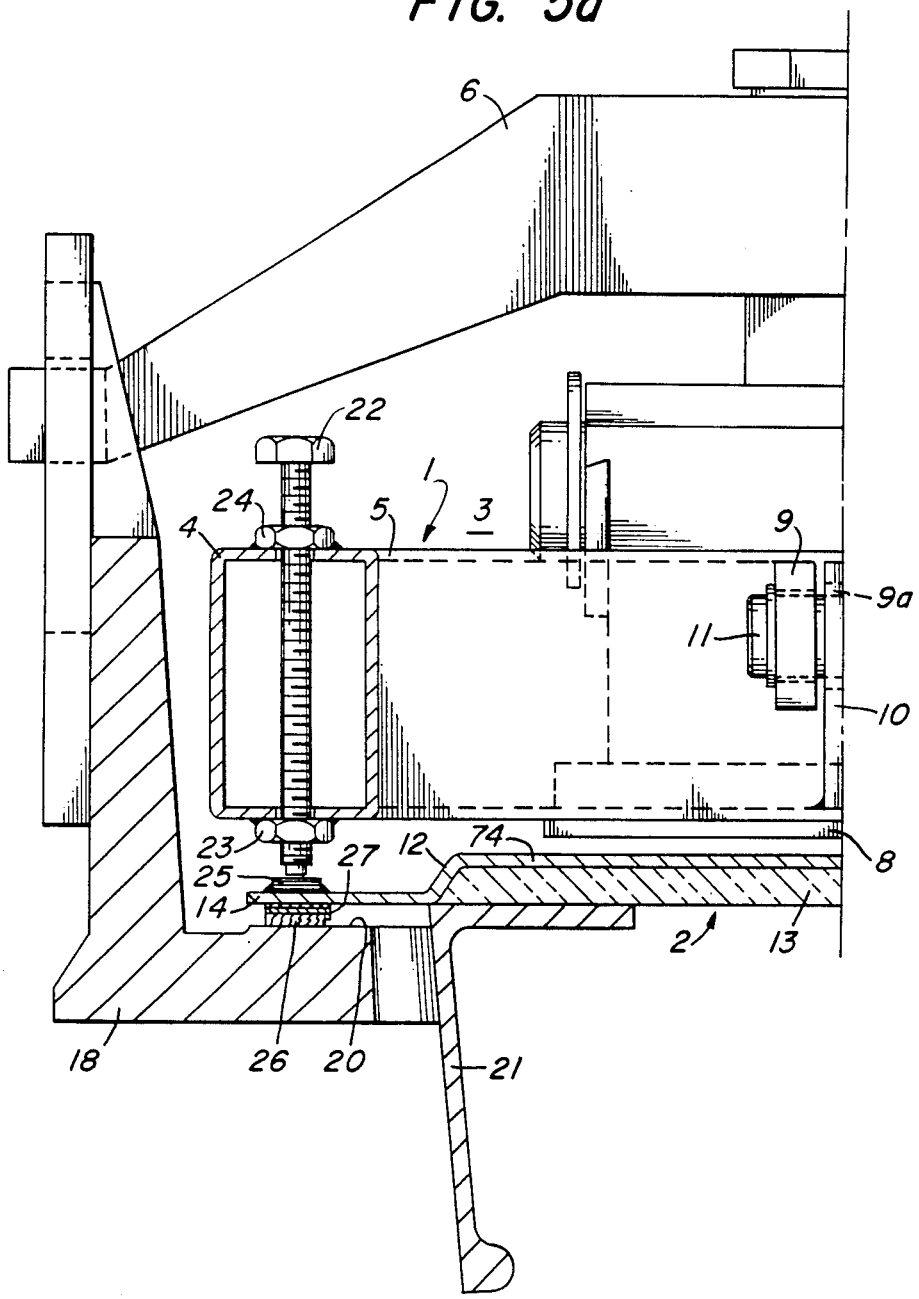

FIG. 5*a* shows a channel density of 74 with low profile depth. This profile is created by bending a plate and provides for a variable profile depths, or avoids depressions in locking devices, if existing equipment must be used.

Figure 6:
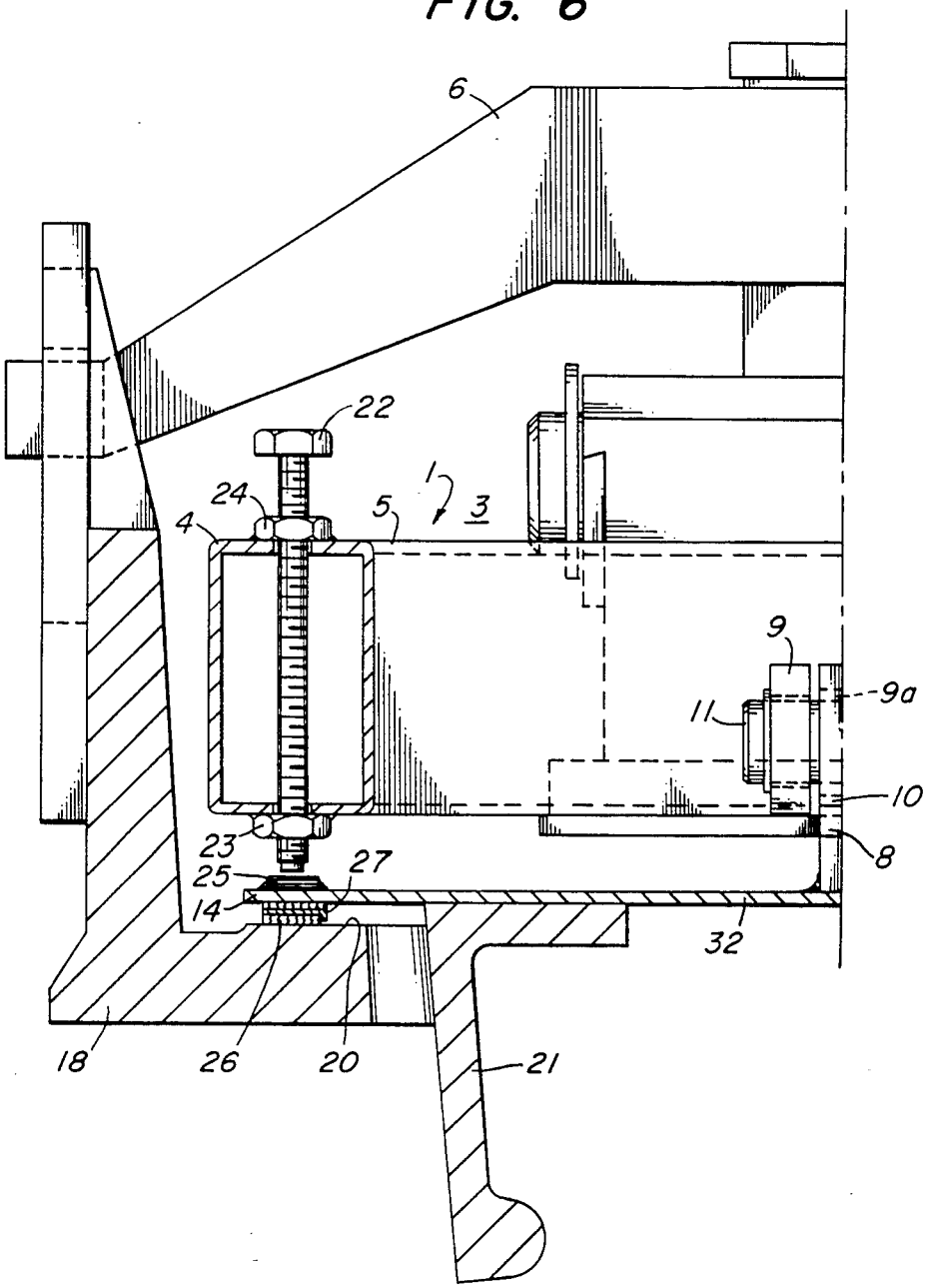

In the extreme case, the sealing element 12 as illustrated in FIG. 6 is shaped as a flat sheet 32.

Figure 7:
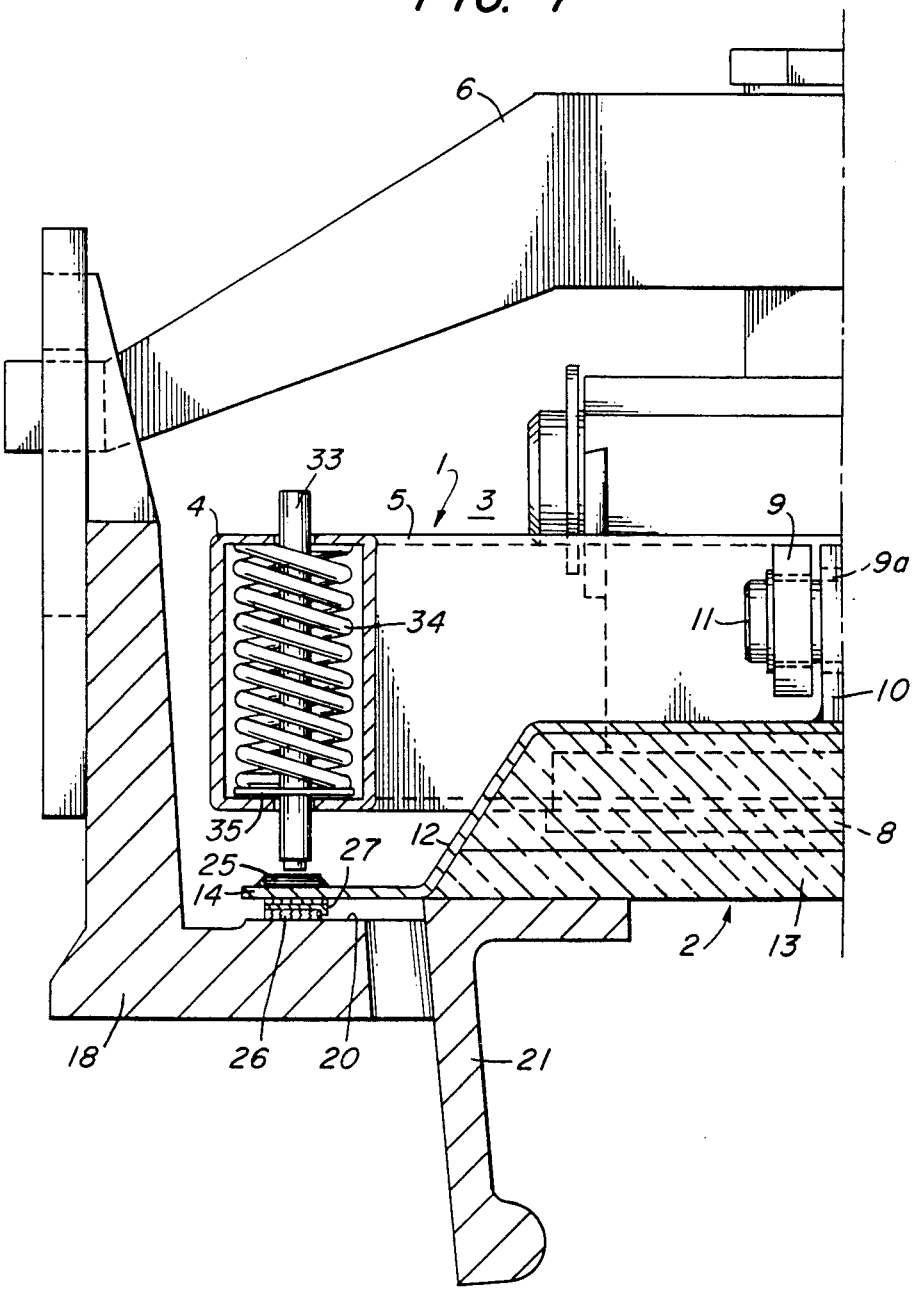

FIG. 7 shows other embodiment of a coke oven door, with spring supported bolts 33, instead of bolts 22. Springs 33 are positioned in members 4 and 5 on bolts 33. One spring end is supported by the member surface, whereas the opposite end of the spring acts against disc 35, which is mounted on bolt 33. This disc is equipped with a centering boss of about 10 mm in length, which protrudes into the inside of the spring. The disc can also be made to abut against a boss (not shown) of the bolt at the other end of the spring 34. This achieves the possibility of assembling spring 34 and disc 35 into members 4 and 5 of the hollow frame, with subsequent installation of bolts 33. The bolts can be secured against loss by means of pins at one end.

Figure 8:
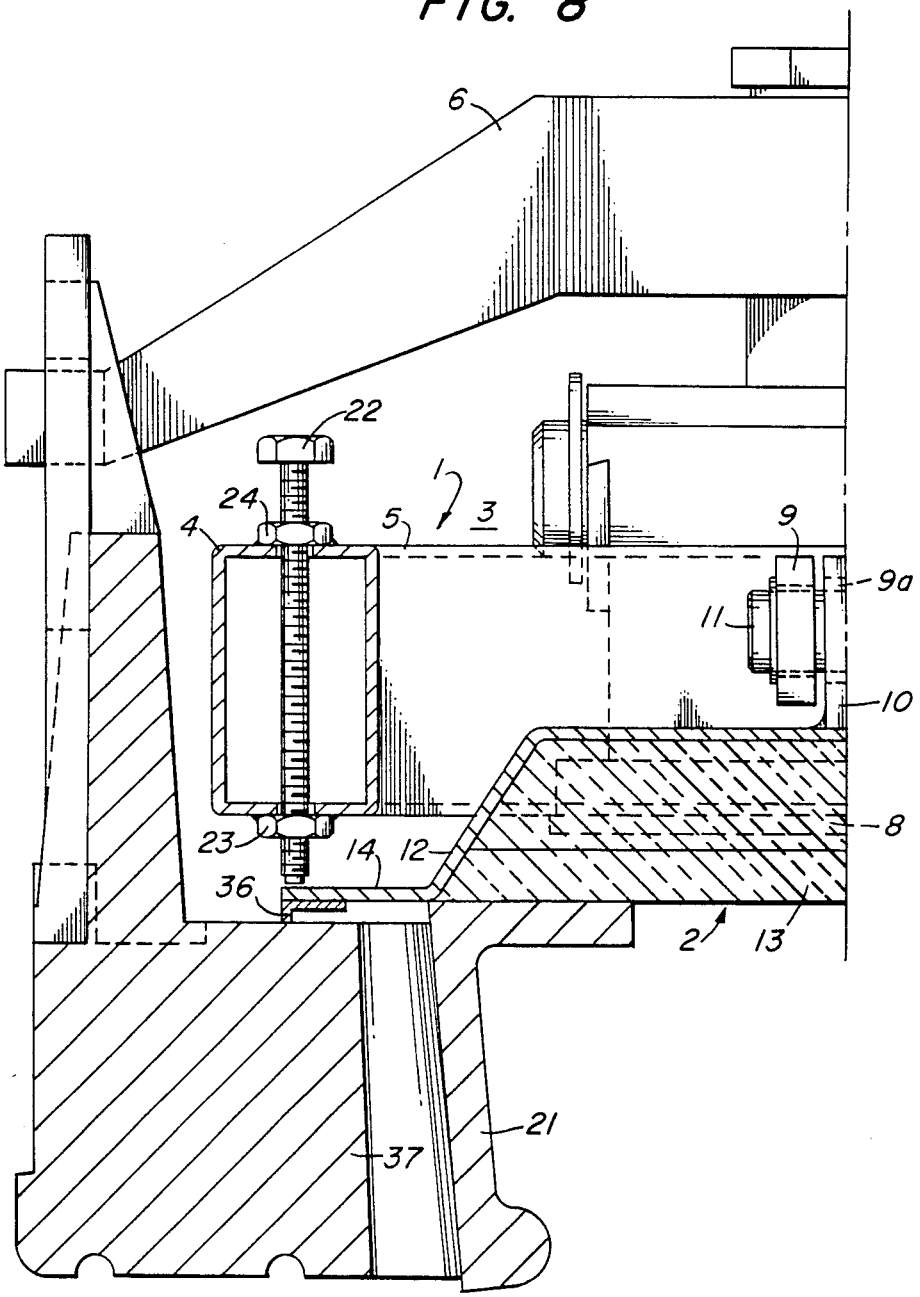

FIG. 8 shows a sealing strip, preferably of steel, instead of soft seal 26 and corner guard 27. The sealing strip is designated as 36 and is bolted continuously with the free leg 12 of sealing unit 2. Sealing strip 36 has an angular shape and presses with its smaller leg against the sealing surface of door frame 37.

Figure 9:
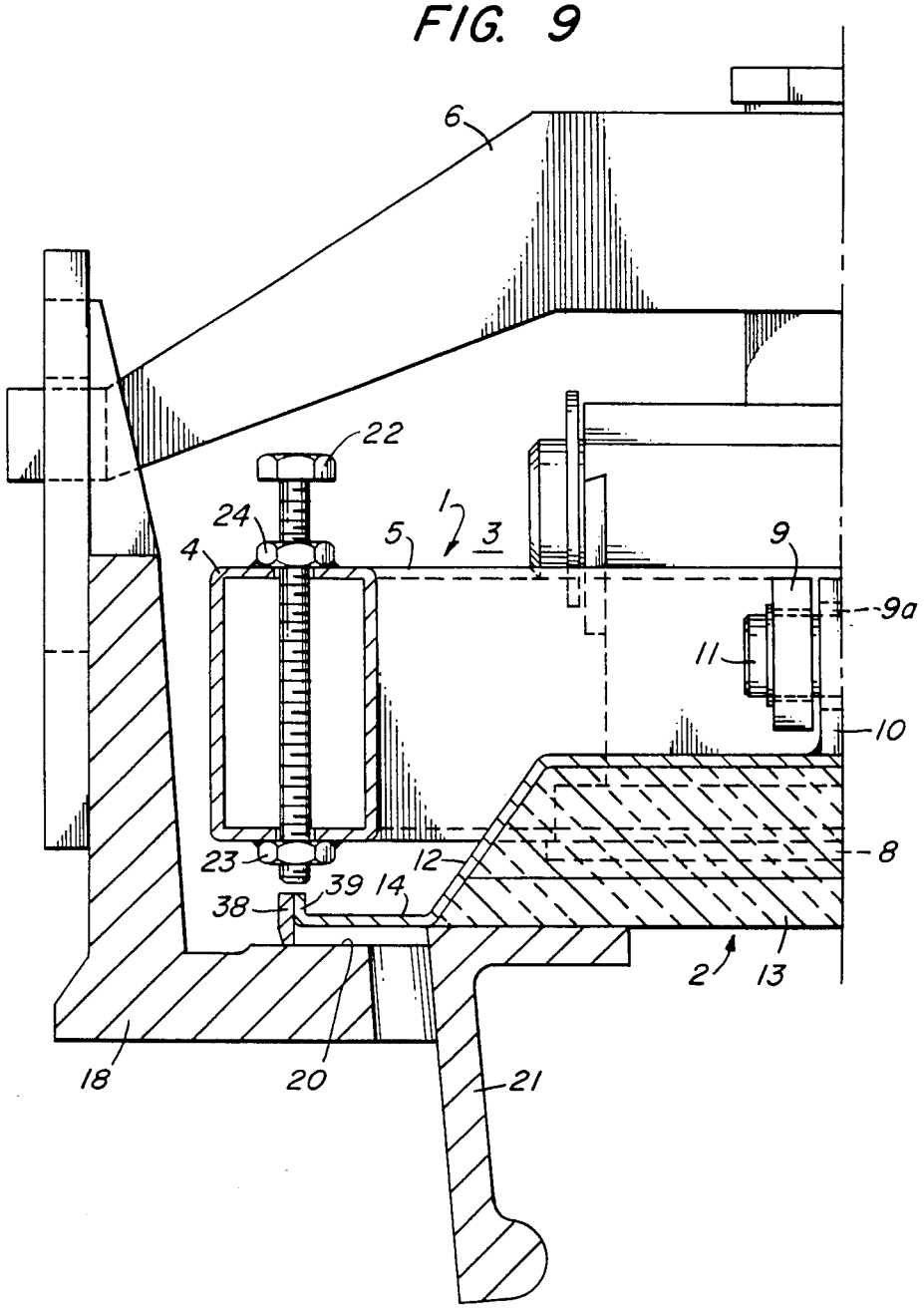
Figure 10:
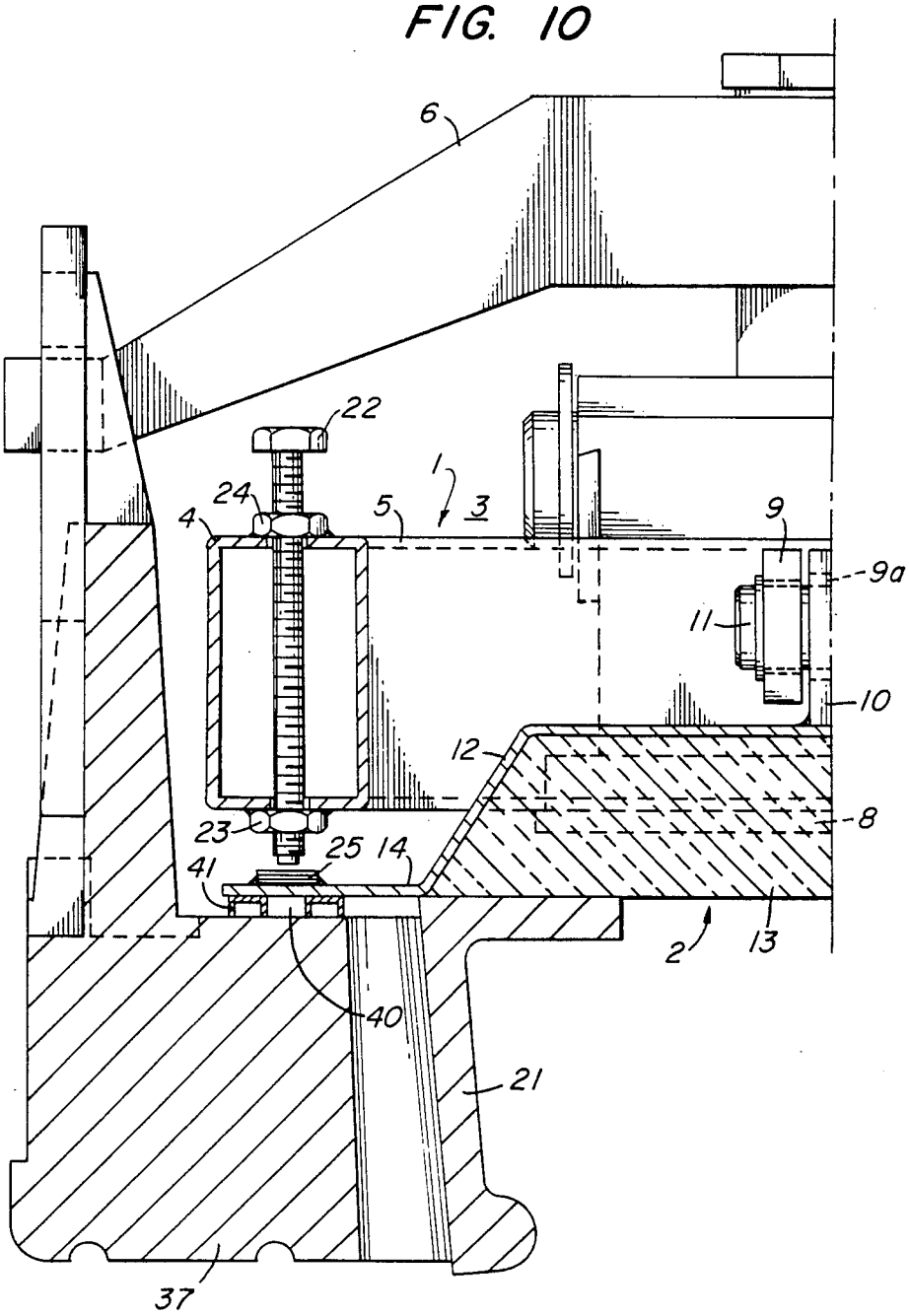

FIG. 9 shows another sample with a similar sealing strip 38 but lower than the cutter-like sealing strips of conventional coke oven doors. To fasten these sealing strips 38, the free leg 14 of sealing element 12 is bent up at the outer end 39. This provides for sufficient design freedom to bolt down sealing strip 38, which can also be replaced as sealing strip 36, in FIG. 8. FIG. 9 shows bolts 22 acting against the high ends of sealing strip 38 and free leg 14. This accomplishes a centered force application of the bolting action on sealing strip 38. FIG. 10 provides another example of a shim 25 and a replaceable labyrinth seal between the free leg 14 and sealing surface 40. The labyrinth seal is formed by two channel sections of metallic or non-metallic material at the free leg 14 of sealing unit 2. These channels are bolted individually to the free leg 14 and are replaceable. They are pressed at an open side against sealing surface 14. FIG. 10 shows channel shapes designated by the numeral 41.

Figure 11:
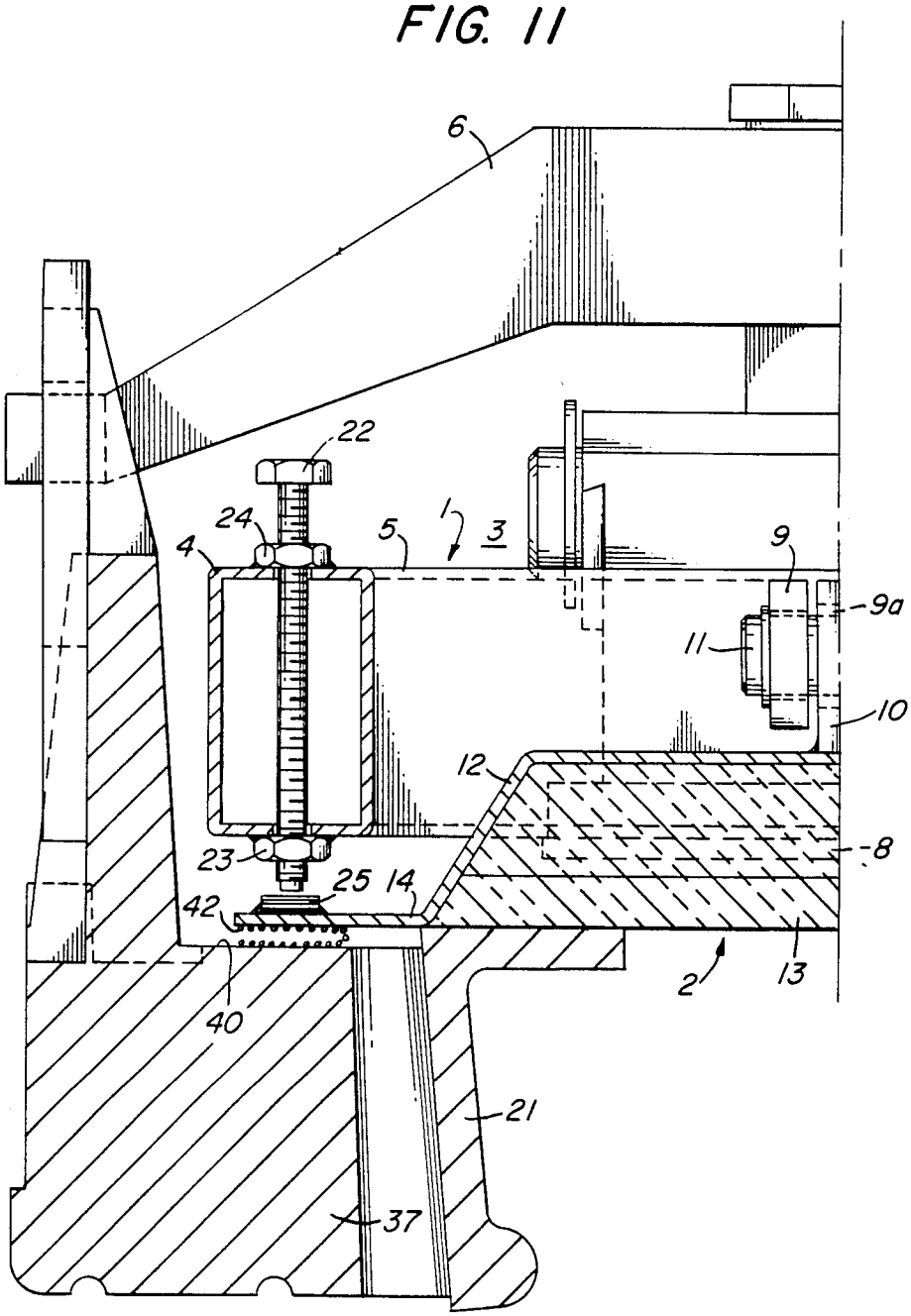

FIG. 11 shows a seal 42 between the free leg of the sealing unit 2 and the sealing surface 40 of the door frame. Seal 42 acts like a spring, which is compressed during sealing, as shown in FIG. 11. The flexible legs will seal against seal 42, with free leg 14 and sealing surface 40 against the ends of the channel in the oven chamber.

Figure 12:
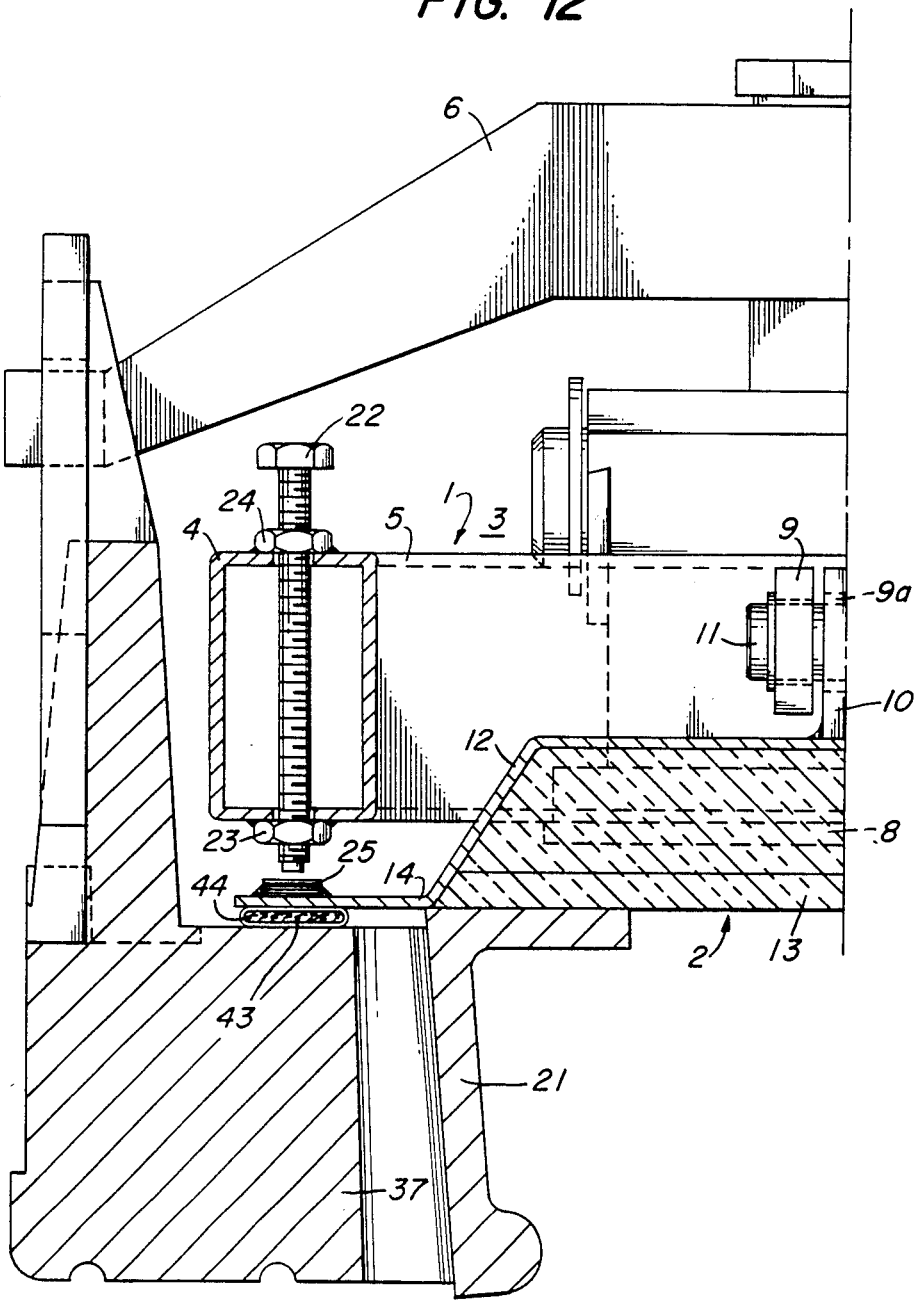

FIG. 12 shows a further sealing unit with the new seal. This seal comprises soft material 43, which is held by a continuous sleeve 44. This sleeve is interchangeable with the free leg 14 of sealing element 12 and bolted together. The sleeve 44 provides the soft material 43 with sufficient support and protects it against escaping furnace gas because of its bulging shape on the side facing the inside of the furnace.

Figure 12A:
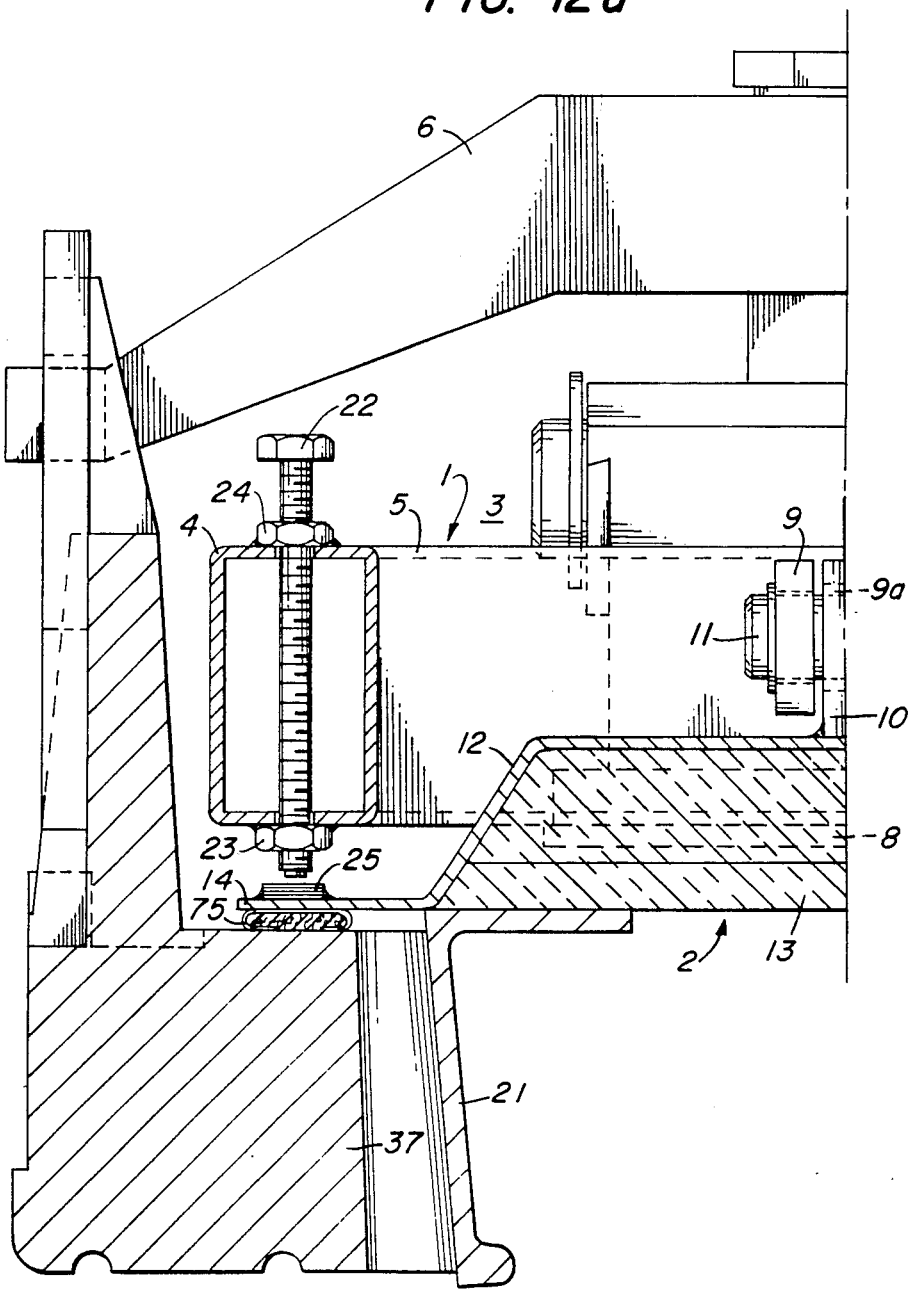

FIG. 12*a* shows a sleeve 75 instead of a sleeve 44. Sleeve 75 is open at the other end, to assure an easy replacement of the seal (soft material 43), and provides sufficient support at the same time. This support can be achieved with bent-up portion at the edge.

Figure 13:
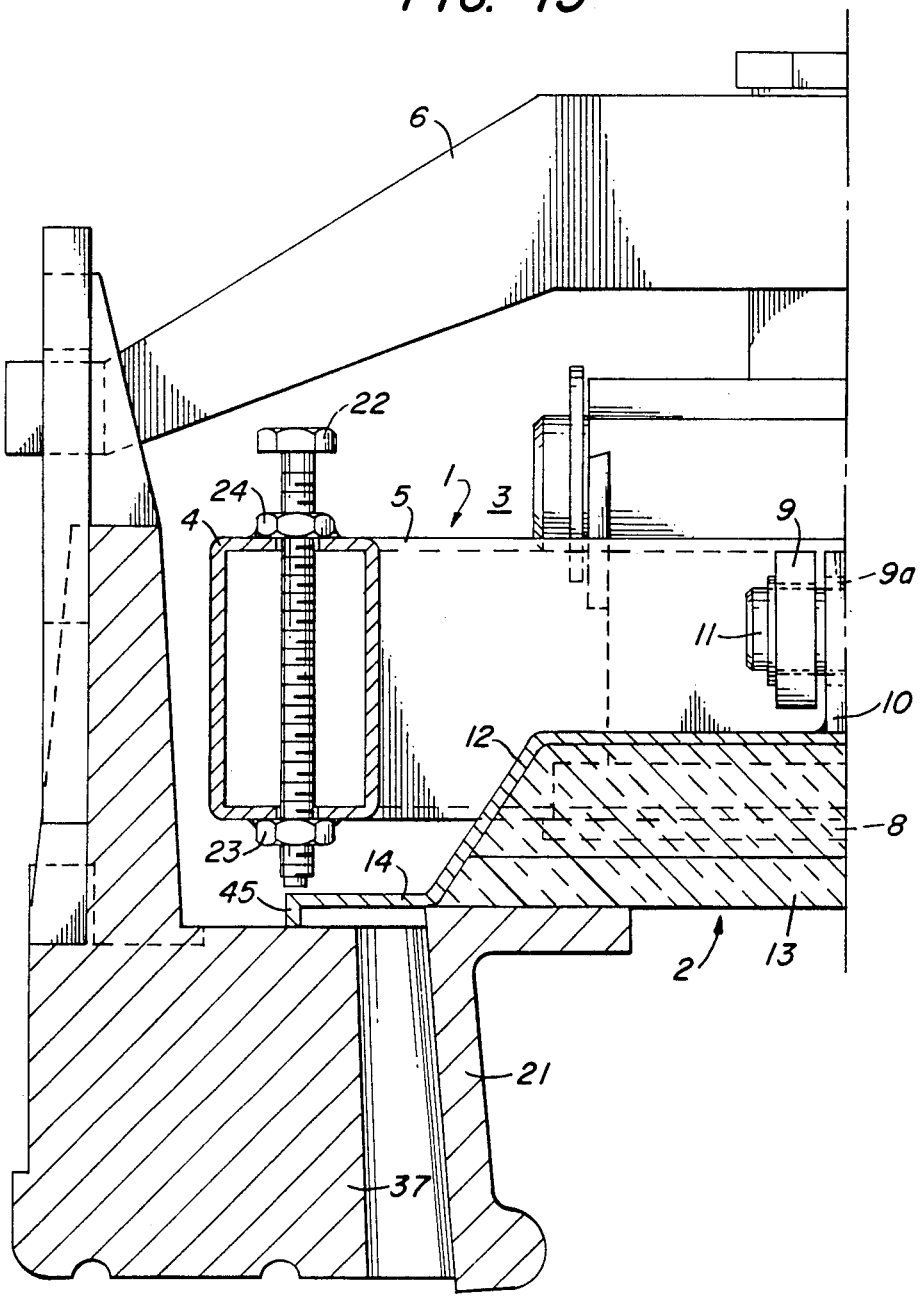

FIG. 13 shows the free leg 14 of the sealing element 12 at the end marked 45, bent against the door frame, so that the bent part 45 forms a single piece with sealing element 12.

Figure 14:
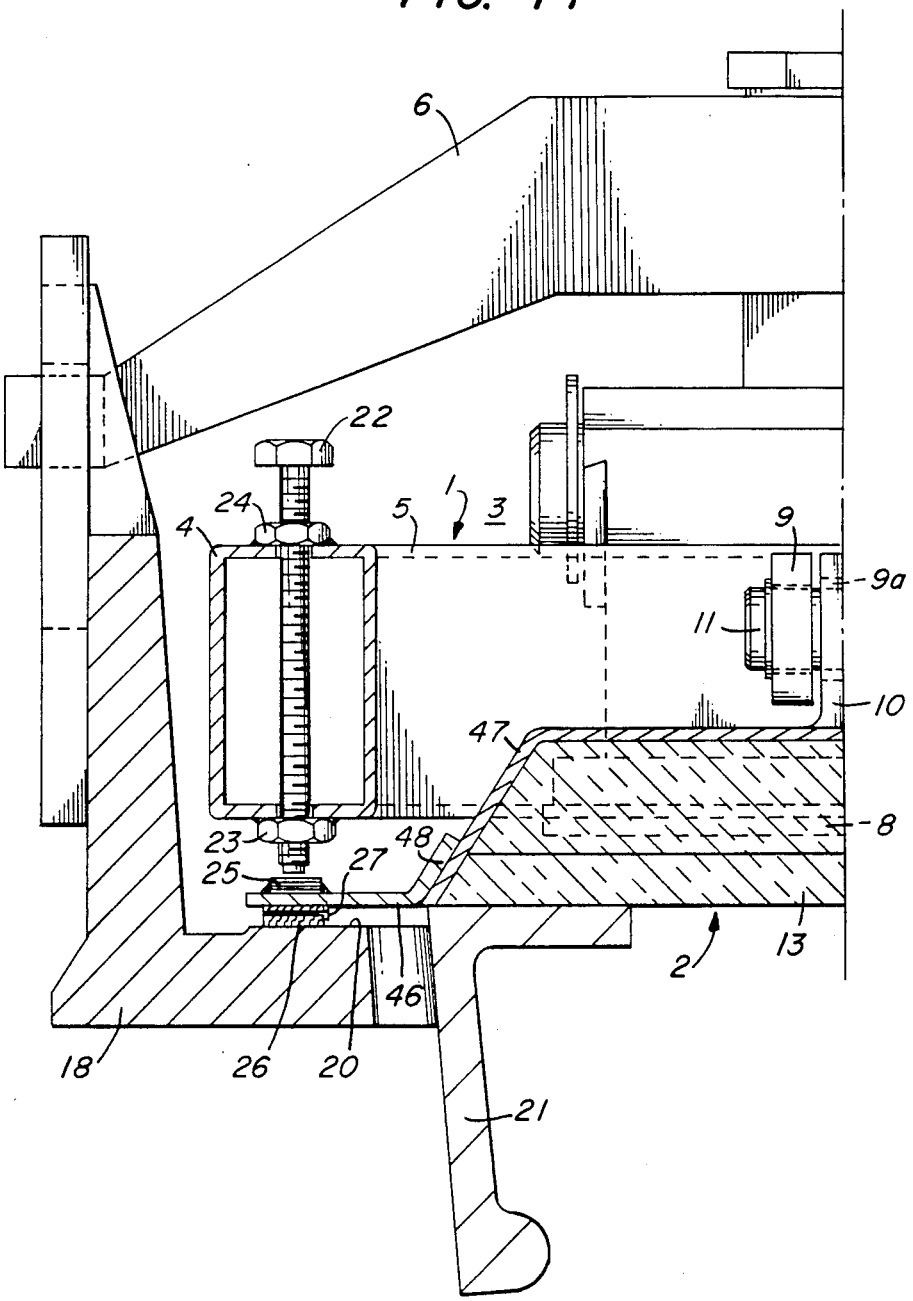

FIG. 14 shows the sealing element in several parts. It comprises a separate free leg 46 which in the cross section forms an angular shape and which forms a continuous frame as shown in FIG. 2. The separate leg 46 has a stop and a back 47, which forms the bulge of the sealing element. The free leg 46 and the bulge with the back portion 47 are bolted together into a frame at 48.

Figure 15:
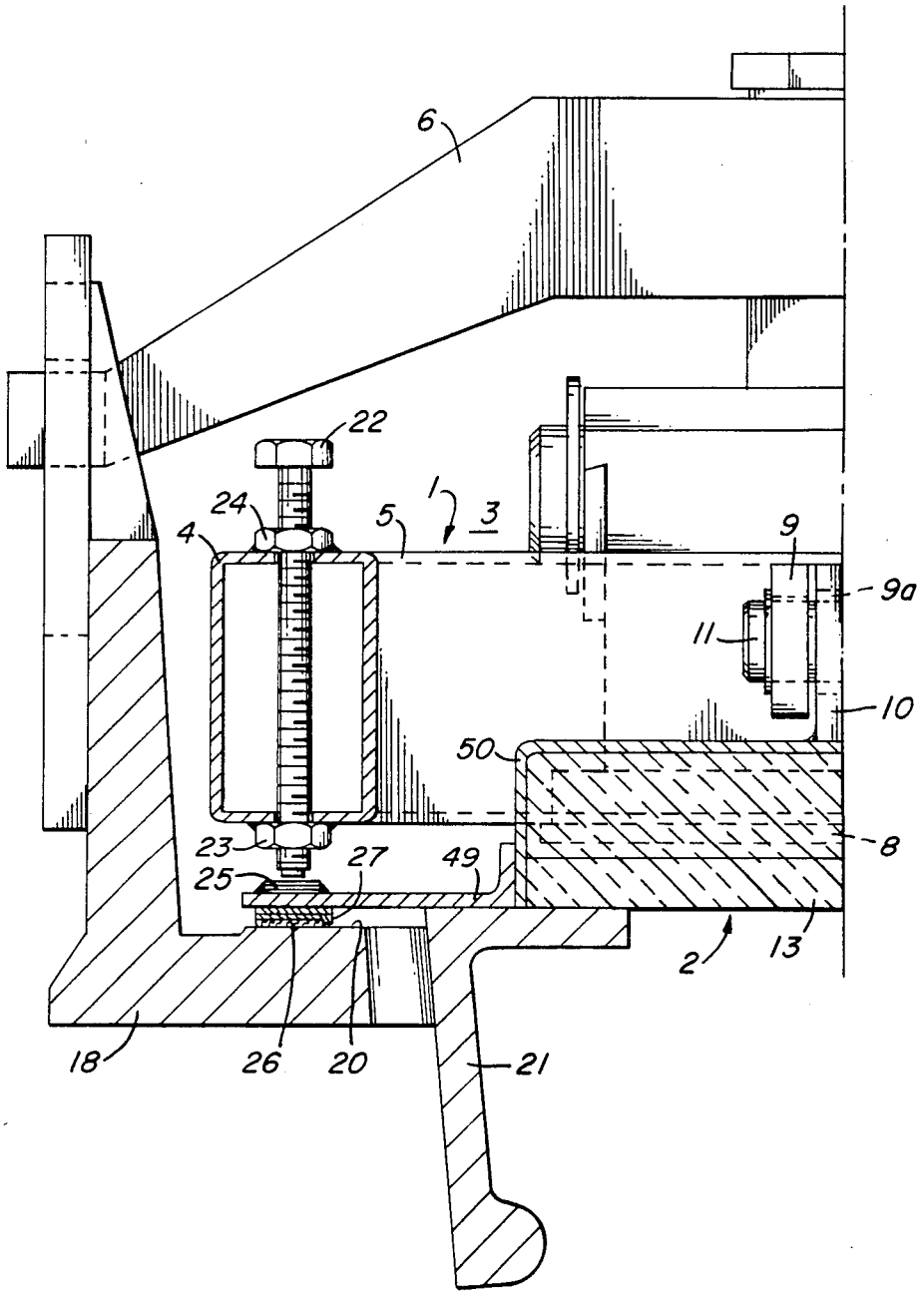
Figure 17:
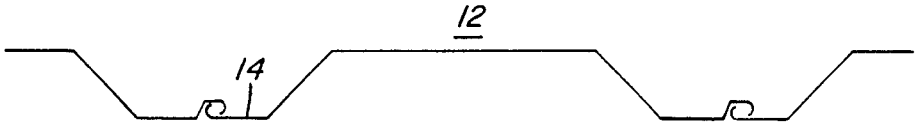
Figure 18:
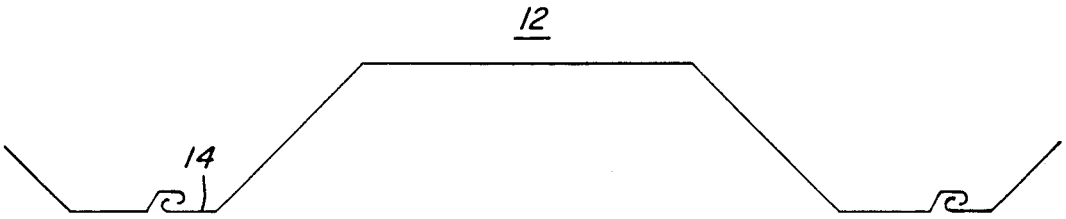
Figure 19:
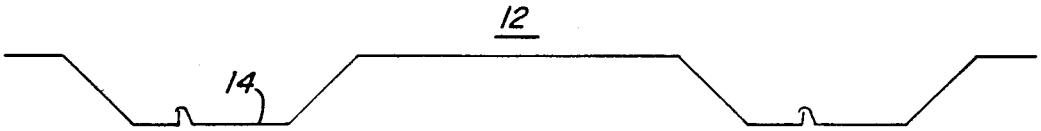

FIG. 15 shows the application of the principles shown in FIG. 14, for multiple component sealing elements of FIG. 4. FIG. 15 shows the free leg 49 and the back 50. FIGS. 16 to 19 are commercial illustrations which are suitable for sealing purposes. The shapes in FIG. 16 are so called plate shapes, whereas the shapes in FIGS. 17 and 18 are light sections, and FIG. 19 shows channel sections.

The invention as described hereinabove in the context of a preferred embodiment, is not to be taken as limited to all of the provided details thereof, since, modifications and variations thereof may be made without departing from the spirit and scope of the invention.

We claim:

1. A coke oven door in combination with a horizontal chamber type coke oven having an oven chamber, said coke oven door comprising vertical door arrangement which comprises:

a door member to retain an oven filling inside said oven chamber, said door member having a sealing element;

a door frame having an opening and a portion with a sealing surface, said door member having a closed position when abutting sad door frame, and an open position when away from said door frame;

said door member having a longitudinal axis;

a door stopper attached to the door member, said door stopper serving as a substantially heat insulating barrier and being disposed to protrude into the oven chamber sufficiently, to keep the oven filling at a predetermined distance from said door member in said closed position;

a separate force transmittal unit for transmitting force around said door member and for forcing said sealing element against said door frame in said closed position;

at least one connecting joint means being disposed for supporting said door member when said door member is moved to said open position, said at least one connecting joint means joining said door member and said force transmittal unit, said supporting being provided through said at least one connecting joint means, said at least one connecting joint means having a first element means and a second element means, said second element means being in a co-operative relationship and making contact with said first element means for supporting said door member in said open position, said first element means being connected to be supported by said force transmittal unit when said door member is in said open position, said second element means being connected to support said door member when said door member is in said open position, said force transmittal unit having means for preventing said door member in said closed position from moving in a direction away from said door frame;

said sealing element having a portion which is disposed to make contact with said sealing surface of said door frame in said closed position;

locking means for providing bearing forces on said force transmittal unit at least to assist in sealing said sealing surface of said door frame with said sealing element of said door member;

said first element means and said second element means of said connecting joint means each having at least one surface directly facing at least one surface of the other element means;

said at least one facing surface of said first element means and said at least one facing surface of said second element means forming a gap therebetween along all parts of said facing surfaces such that said first element means and said second element means are non-touchingly disposed from one another in said closed position, whereby heat transfer between said first element means and said second element means because of said gap is minimized in said closed position; and at least a portion of said at least one facing surface of said first element means making said contact, between said first and said second element means, with at least a portion of said at least one facing surface of said second element means when said door member is in said open position.

2. The coke oven door arrangement according to claim 1 wherein said second element includes a connecting bolt having said gap completely thereabout in said closed position and to retain said door member with said force transmittal unit when said door member is in said open position.

3. The coke oven door arrangement according to claim 2 wherein said coke oven door has a vertical direction and a horizontal direction and said gap provides a play of at least 3 mm in the horizontal direction between said door member and said force transmittal unit.

4. The coke oven door arrangement according to claim 3 wherein said gap provides a play in the vertical direction which amounts to at least 5 mm plus an allowance for heat expansion occurring at the connecting joint means, which expansion is caused by the door member.

5. The coke oven door arrangement in combination with a coke oven according to claim 3 wherein said gap is provided at least in part by one of said two element means by an elongated hole being elongated in the vertical direction of said door to provide an opening for a bearing surface of the other element means when said door member is in said open position.

6. The coke oven door arrangement according to claim 1 wherein said second element comprises a pivot bolt for loosely joining said door member and said force transmittal unit.

7. The coke oven door arrangement according to claim 1 wherein said second element includes pivot bolt means disposed to support said door member from said force transmittal unit in a slack relationship when said door member is open, said pivot bolt means providing said gap in said closed position.

8. The coke oven door arrangement according to claim 1 wherein one of said first element means and said second element means comprises at least one clevis and the other of said first element means and said second element means comprises at least one pivot bolt, each said clevis having a corresponding pivot bolt;

said at least one clevis, each having surfaces for loosely receiving its corresponding pivot bolt when said door member is in said closed position;

said at least one clevis having its corresponding pivot bolt disposed adjacent said surfaces for receiving its corresponding pivot bolt.

9. The coke oven door arrangement according to claim 8 wherein said surfaces of said at least one clevis adjacent said bolt form an elongated hole for having said bolt disposed therein.

10. The coke oven door arrangement according to claim 9 wherein said elongated hole has its elongation being formed substantially in the same direction as said longitudinal axis of said door member.

11. The coke oven door arrangement according to claim 8 wherein a boss supporting said bolt is connected to said door member and said clevis is connected to said force transmittal unit and said boss is disposed to support said door member by said bolt when said door member is in its open position.

12. The coke oven door arrangement according to claim 9 wherein a boss supporting said bolt is connected to said door member and said clevis is connected to said force transmittal unit and said boss is disposed to support said door member by said bolt when said door member is in its open position.

13. The coke oven door arrangement according to claim 10 wherein a boss supporting said bolt is connected to said door member and said clevis is connected to said force transmittal unit and said boss is disposed to support said door member by said bolt when said door member is in its open position.

14. The coke oven door arrangement according to claim 1 wherein said connecting joint means is disposed at a central portion of said door member.

15. The coke oven door arrangement according to claim 14 wherein said connecting joint means comprises two connecting joints disposed at a lower central portion and the other at an upper central portion of said door member.

16. The coke oven door arrangement according to claim 1 wherein said force transmittal unit frame has cross members crossing a central portion of said door member adjacent said connecting joint means;

said at least one connecting joint means comprising two connecting means, each of two connecting joint means having a corresponding one of said cross members; and wherein one of said element means of each said connecting joint means is connected to its corresponding cross member.

* * * * *